United States Patent [19]

Kostadinov et al.

[11] 4,007,248

[45] Feb. 8, 1977

[54] METHOD OF PRODUCING DELUSTERED POLYACRYLONITRILE FIBERS

[75] Inventors: Spas Kostadinov Kostadinov; Iveta Markova Benrey; Vassil Angelov Shopov; Marika Yokimova Kostadinova; Maria Staneva Dimitrova, all of Burgas, Bulgaria

[73] Assignee: DSO "Neftochim", Burgas, Bulgaria

[22] Filed: Dec. 23, 1974

[21] Appl. No.: 536,949

Related U.S. Application Data

[63] Continuation-in-part of Ser. No. 503,616, Sept. 6, 1974, abandoned.

[52] U.S. Cl. ..... 264/182; 260/DIG. 23; 260/876 R

[51] Int. Cl.[2] ..... D01F 6/18; C08L 51/04

[58] Field of Search ..... 260/876 R, DIG. 23, 260/879; 264/182

[56] References Cited

UNITED STATES PATENTS

| | | | |
|---|---|---|---|
| 3,010,936 | 11/1961 | Irvin | 260/876 R |
| 3,118,854 | 1/1964 | Hess et al. | 260/876 R |
| 3,231,536 | 1/1966 | Voeks | 260/881 |
| 3,793,277 | 2/1974 | Thompson | 264/182 |
| 3,821,348 | 6/1974 | Planz | 264/182 |
| 3,846,226 | 11/1974 | Smithey | 260/DIG. 23 |
| 3,846,509 | 11/1974 | Saluti | 260/876 R |
| 3,851,014 | 11/1974 | Dalton | 260/876 R |

*Primary Examiner*—Murray Tillman
*Assistant Examiner*—Thurman K. Page

[57] ABSTRACT

A method for obtaining delustered polyacrylonitrile fibers, wherein fibers are formed from a spinning solution, that is, being a mixture of two copolymer solutions, one of them being polyacrylonitrile and the other a ter grafted copolymer of acrylonitrile and styrene on rubber such as butadiene or butadiene-styrene rubber-ABS-copolymer.

5 Claims, No Drawings

METHOD OF PRODUCING DELUSTERED POLYACRYLONITRILE FIBERS

This application is a continuation-in-part of application Ser. No. 503,616, filed Sept. 6, 1974, now abandoned.

The present invention relates to a method for producing delustered polyacrylonitrile fibers with an increased degree of whiteness from mixtures of polyacrylonitrile and graft copolymer of acrylonitrile and styrene on various kinds of rubbers.

It is known that polyacrylonitrile fibers are delustered exclusively by means of titanium dioxide in a quantity of up to 0.5% of the polyacrylonitrile. It is a disadvantage that the polyacrylonitrile fibers, delustered by means of titanium dioxide, which are obtained from a polyacrylontrile dissolved in dimethylformamide, dimethylamine, dimethylacetamide, ethylene carbonate and other solvents, have a comparatively small degree of whiteness, a yellowish hue.

Paraffin, mineral oil and their mixtures have been used so far for dulling polyacrylonitrile fibers. The fibers thus delustered have a small degree of whiteness, a yellowish hue, and a low thermostability; as a result, these dulling methods are not used in the industry.

It is an object of the invention to obtain delustered polyacrylonitrile fibers with an increased degree of whiteness and higher elasticity from mixtures of polyacrylonitrile and ter grafted copolymers of acrylonitrile and styrene on butadiene, butadiene-styrene, isoprene, isoprene-styrene, chloroprene, chloroprenestyrene rubbers or their mixtures.

The method for obtaining delustered polyacrylonitrile fibers with an increased degree of whiteness according to the invention is based on their forming out of a spinning solution of a two-polymer mixture, one of them being polyacrylonitrile and the other a ter grafted copolymer (ABS) of acrylonitrile and styrene on butadiene rubber or butadiene-styrene rubber. The polyacrylonitrile (PAN) stands for a homopolymer or a copolymer of the acrylonitrile containing at least 80% by weight acrylonitrile. Such copolymers can be produced under the copolymerization of acrylonitrile with other vinyl monomers such as methyl methacrylate, methyl acrylate, vinyl acetate, vinyl sulphonate, allyl sulphonate, methylsulphonate, vinyl pyridine, itaconic acid, acrylic acid and others.

The formation of the delustered polyacrylontrile fibers out of these polymer mixtures are obtained from their solutions in dimethylformamide (DMF), dimethylamine, dimethylacetamide and other solvents which simultaneously dissolve the polyacrylonitrile and the grafted copolymers of the acrylonitrile and the styrene on various kinds of rubbers. Delustered polyacrylonitrile fibers with an increased degree of whiteness and increased elasticity are obtained from mixtures containing 90 to 99.8% by weight polyacrylonitrile and 0.2 to 10% by weight ABS copolymers. The copolymers are usually not mixed but only dissolved in DMF or other solvents and the solution obtained is mixed in definite ratios for obtaining polyacrylonitrile fibers with the content desired. The fibers thus obtained and containing up to 3% by weight (ABS-copolymer) can be additionally delustered with titanium dioxide of a quantity maximum 0.2% by weight (related to both copolymers) for obtaining the dullness. The fibers containing 3 and above 3% by weight ABS-copolymers have the same dullness as those delustered with 0.5% by weight (related to the polyacrylonitrile) titanium dioxide. The delustered polyacrylonitrile fibers obtained from mixtures of the polyacrylonitrile (PAN) and grafted ABS-copolymer have an increased degree of whiteness and higher elasticity as compared to the polyacrylonitrile fibers obtained merely from polyacrylonitrile and delustered with 0.5% by weight titanium dioxide (Kronos-AD, Italy). The data are shown in the Table.

The following Examples more fully explain the invention.

EXAMPLE 1

Obtaining of delustered polyacrylonitrile fibers 3.3 d/tex containing 99.5% polyacrylonitrile and 0.5% ABS-copolymer (all percentage are by weight).

When filtering, the dimethylformamide solutions of the polyacrylonitrile are being mixed with ABS-copolymer in the following ratio: 75 ml/min 25% solution of the copolymer of the acrylonitrile — 93%, methylmethacrylate — 6%, sodium vinylsulphonate — 1% — polyacrylonitrile, containing 0.5% (in relation to the polyacrylonitrile) oxalic acid and 0.02% (related to the polyacrylonitrile) optical dissolvent UVITEX MA and 1.88 ml/min 5% solution from ABS-copolymers.

The formation of the fibers from the spinning solution thus prepared is carried out by the well-known moist method of spinning in a sedimentary bath containing 50% dimethylformamide and 50% water. The fibers obtained have the following properties: Degree of whiteness — 77.8%; tenacity — 25.5 CN/tex; elongation — 33%.

EXAMPLE 2

Obtaining of delustered polyacrylonitrile fibers 3.3 d/tex containing 99% polyacrylonitrile and 1% ABS-copolymer (all percentages are by weight).

Before being filtered, the solvents of the polyacrylonitrile and the ABS-copolymer are mixed in the following ratio: 75 ml/min 25% solution of the polyacrylonitrile in dimethylformamide with a content as in the first example and 3.78 ml/min 5% solution of the ABS-copolymer in dimethylformamide.

From the spinning solution thus prepared the fibers are obtained as in the first example. The fibers are characterized by the following properties: Degree of whiteness —78.6%; tenacity — 24.38 CN/tex; elongation — 33.4%.

EXAMPLE 3

Obtaining of delustered polyacrylonitrile fibers 3.3 d/tex containing 98% polyacrylonitrile and 2% ABS-copolymer (all percentages are by weight).

Before filtering, the solutions of the polyacrylonitrile and the ABS-copolymer are mixed in the following ratio: 75 ml/min 25% solution of the polyacrylonitrile in dimethylformamide with a content as in the first Example and 7.64 ml/min 5% solution of the ABS-copolymer in dimethylformamide. From the spinning solution thus prepared, the fibers are obtained as in the first Example. The fibers are characterized by the following properties: Degree of whiteness — 79.5%; tenacity — 24.2 CN/tex; elongation — 33.1%.

EXAMPLE 4

Obtaining of delustered polyacrylonitrile fiber 3.3 d/tex containing 97% polyacrylonitrile and 3% ABS—copolymer (all percentages are by weight).

Before filtering, the solutions of the polyacrylonitrile and the ABS-copolymer are mixed in the following ratio: 75 ml/min 25% solution of the polyacrylonitrile in dimethylformamide with a content as in the first Example and 11.60 ml/min 5% solution of the ABS-copolymer in dimethylformamide. From the spinning solution thus prepared the fibers are obtained as in the first Example. The fibers are characterized by the following properties: Degree of whiteness — 80.8%; tenacity — 23.8 CN/tex; elongation — 31.8%.

EXAMPLE 5

Obtaining of delustered polyacrylonitrile fibers 3.3 d/tex containing 98% polyacrylonitrile, 2% ABS-copolymer and 0.1% (related to the polyacrylonitrile and the ABS-copolymer) titanium dioxide (KRANOS AP) (all percentages are by weight).

Before filtering, the solution of polyacrylonitrile and the ABS-copolymer are mixed in the following ratio: 75 ml/min 25% solution of the polyacrylonitrile in dimethylformamide with a content as in the first Example and 7.64 ml/min 5% solution of the ABS-copolymer in dimethylformamide containing 0.25 % titanium dioxide.

From the spinning solution thus prepared the fibers are obtained as in the first example. The fibers are characterized by the following properties: Degree of whiteness — 78.9%; tenacity — 23.4 CN/tex; elongation — 32.3%.

TABLE

| No. | Content of the fibers | at break CN/tex | Elongation at break % | Loop tenacity CN/tex | Loop tenacity % | Degree of whiteness |
|---|---|---|---|---|---|---|
| 1 | 99.5% PAN 0.5% ABS | 25.5 | 33.0 | 14.90 | 58 | 77.8 |
| 2 | 99.0% PAN 1.0% ABS | 24.38 | 33.4 | 15.10 | 62 | 78.6 |
| 3 | 98.0% PAN 2.0% ABS | 24.2 | 33.1 | 16.00 | 66 | 79.5 |
| 4 | 97.0% PAN 3.0% ABS | 23.8 | 31.8 | 16.20 | 68 | 80.8 |
| 5 | 98.0% PAN 2.0% ABS 0.1% TiOz (related to PAN and ABS) | 23.4 | 32.3 | 14.10 | 60 | 78.9 |
| 6 | 100 % PAN 0.5% TiOz (related to PAN) | 23.0 | 31.6 | 11.24 | 49 | 75 |

Although the invention is illustrated and described with reference to a plurality of preferred embodiments thereof, it is to be expressly understood that it is in no way limited to the disclosure of such a plurality of embodiments, but is capable of numerous modifications within the scope of the appended claims.

What is claimed is:

1. A method for preparing delustered polyacrylonitrile fibers evidencing a high degree of whiteness and elasticity which comprises wet spinning a fiber forming polymeric solution consisting essentially of a. a polyacrylonitrile polymer containing at least 80%, by weight, acrylonitrile, and b. a ter grafted ABS copolymer of acrylonitrile and styrene on a rubber, the polyacrylonitrile being present in an amount ranging from 90–99.8%, by weight, and the ter grafted ABS copolymer in an amount ranging from 0.2–10%, by weight.

2. A method in accordance with claim 1, wherein the blend consists essentially of 99.5%, by weight, polyacrylonitrile, and 0.5%, by weight, ter grafted ABS-copolymer.

3. A method in accordance with claim 1, wherein the blend consists essentially of 99%, by weight, polyacrylonitrile, and 1%, by weight, ter grafted ABS-copolymer.

4. A method in accordance with claim 1, wherein the blend consists essentially of 98%, by weight, polyacrylonitrile, and 2%, by weight, ter grafted ABS-copolymer.

5. A method in accordance with claim 1, wherein the blend consists essentially of 97%, by weight, polyacrylonitrile, and 3%, by weight, ter grafted ABS-copolymer.

* * * * *